US008781362B2

(12) United States Patent
Kubo et al.

(10) Patent No.: US 8,781,362 B2
(45) Date of Patent: Jul. 15, 2014

(54) IMAGE FORMING APPARATUS

(71) Applicant: Fuji Xerox Co., Ltd., Tokyo (JP)

(72) Inventors: Keisuke Kubo, Kanagawa (JP); Atsushi Funada, Kanagawa (JP); Ryuji Hattori, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 65 days.

(21) Appl. No.: 13/665,036

(22) Filed: Oct. 31, 2012

(65) Prior Publication Data

US 2013/0195514 A1 Aug. 1, 2013

(30) Foreign Application Priority Data

Jan. 27, 2012 (JP) ..... 2012-015631

(51) Int. Cl.
*G03G 15/08* (2006.01)
*G03G 21/16* (2006.01)

(52) U.S. Cl.
USPC ..... 399/119

(58) Field of Classification Search
CPC ..... G03G 15/0896
USPC ..... 399/111, 119
See application file for complete search history.

(56) References Cited

U.S. PATENT DOCUMENTS

| | | | | |
|---|---|---|---|---|
| 5,406,355 | A * | 4/1995 | Komuro et al. | 399/111 |
| 5,881,341 | A * | 3/1999 | Kumar et al. | 399/111 |
| 6,226,464 | B1 * | 5/2001 | Suwa et al. | 399/27 |
| 6,842,598 | B2 * | 1/2005 | Kibune et al. | 399/223 |
| 7,120,374 | B2 * | 10/2006 | Karakama et al. | 399/111 |
| 2002/0181974 | A1 | 12/2002 | Sekiguchi | |
| 2013/0195512 | A1 * | 8/2013 | Kubo et al. | 399/269 |

FOREIGN PATENT DOCUMENTS

| | | |
|---|---|---|
| JP | 2002-351211 A | 12/2002 |
| JP | 2002-357951 A | 12/2002 |

* cited by examiner

*Primary Examiner* — Clayton E Laballe
*Assistant Examiner* — Leon W Rhodes, Jr.
(74) *Attorney, Agent, or Firm* — Sughrue Mion, PLLC

(57) ABSTRACT

An image forming apparatus includes a housing, a latent image carrier, and a developing device. The developing device includes a container, a supporter, first and second developer-transporting members, first and second magnets, a pair of first urging members, and a pair of second urging members. The pair of first urging members presses the container toward the latent image carrier while being interposed between the supporter and the container. The first urging members serve as two vertexes of a first triangle surrounding the center of gravity of part of the developing device excluding the supporter. The pair of second urging members presses the container toward the latent image carrier while being interposed between the supporter and the container. The second urging members serve as two vertexes of a second triangle surrounding the center of gravity of part of the developing device excluding the supporter.

8 Claims, 6 Drawing Sheets

IMAGE FORMING APPARATUS

CROSS-REFERENCE TO RELATED APPLICATIONS

This application is based on and claims priority under 35 USC 119 from Japanese Patent Application No. 2012-015631 filed Jan. 27, 2012.

BACKGROUND

1. Technical Field

The present invention relates to image forming apparatuses.

2. Summary

According to an aspect of the invention, an image forming apparatus includes a housing; a latent image carrier that is rotatably supported by the housing, the latent image carrier being cylindrical, the latent image carrier having a surface on which an electrostatic latent image is formed and developed; a developing device that develops the electrostatic latent image formed on the latent image carrier; and a supporter that is secured to the housing, the supporter supporting a container of the developing device such that the container is movable toward or away from the latent image carrier. The developing device includes the container that contains a developer, a first developer-transporting member and a second developer-transporting member each having a rotation axis that is substantially parallel with a rotation axis of the latent image carrier, the first and second developer-transporting members each being disposed such that a circumferential surface thereof faces the latent image carrier, the first and second developer-transporting members each transporting the developer to a position at which the developer faces the latent image carrier by rotating in a circumferential direction of the circumferential surface while carrying the developer on the circumferential surface, and the first and second developer-transporting members being positioned so as to be adjacent to each other, a first magnet and a second magnet disposed inside the first and second developer-transporting members, respectively, the first and second magnets attracting the developer to the circumferential surfaces of the first and second developer-transporting members, respectively, and a pair of first urging members pressing the container toward the latent image carrier while being interposed between the supporter and the container at a first end portion in a direction of the rotation axes of the first and second developer-transporting members. When the image forming apparatus is projected in the direction of the rotation axis of the latent image carrier, the center of gravity of the developing device is positioned so as to be surrounded by a triangle in which the rotation axis of the latent image carrier, a portion of the container at which one of the first urging members presses, and a portion of the container at which the other first urging member presses serve as vertexes of the triangle.

BRIEF DESCRIPTION OF THE DRAWINGS

An exemplary embodiment of the present invention will be described in detail based on the following figures, wherein:

FIG. 5A is a cross-sectional view and FIG. 5B is a schematic side view.

DETAILED DESCRIPTION

Figure 1:
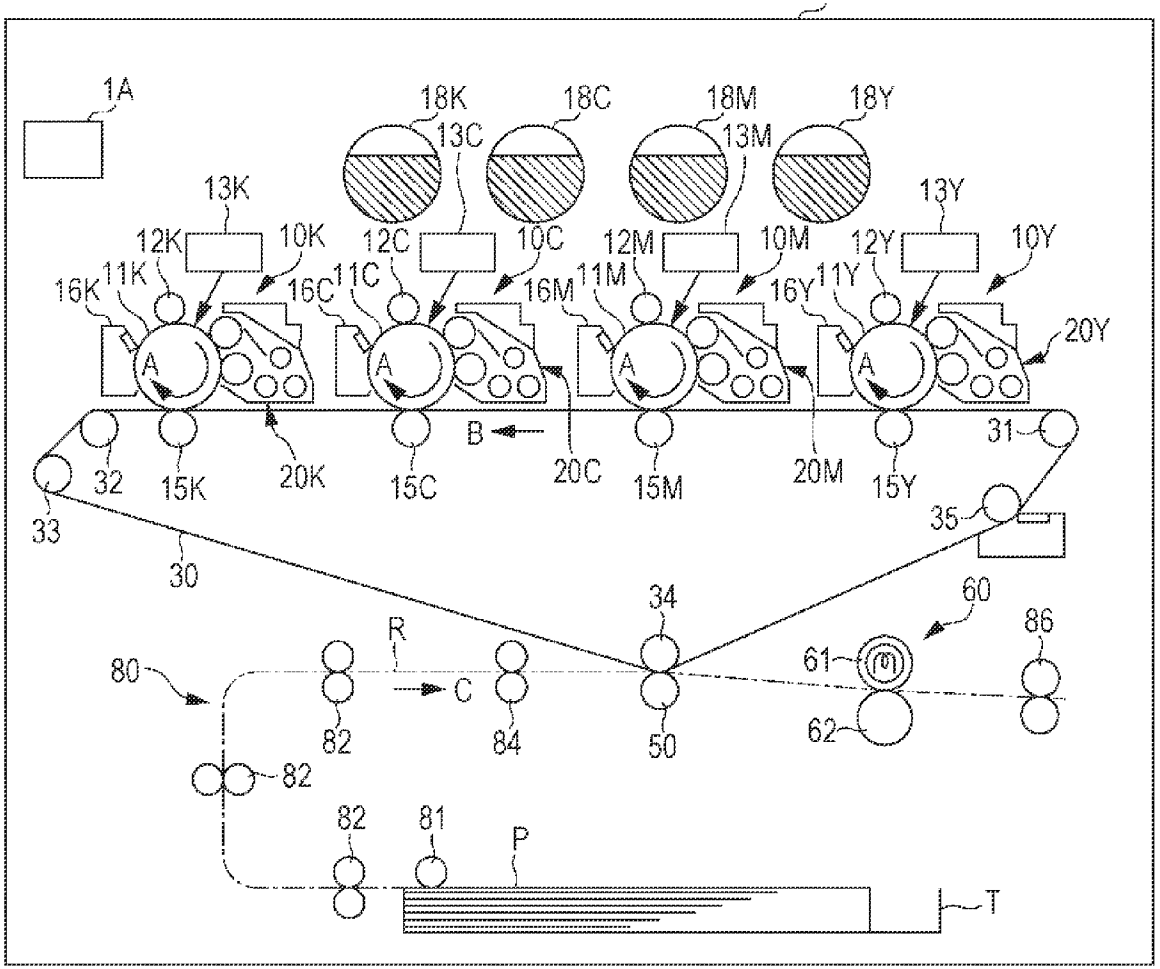
FIG. 1 illustrates a configuration of an image forming apparatus according to an exemplary embodiment of the invention.

Referring to the drawings, an exemplary embodiment of the invention will be described below.

FIG. 1 illustrates a configuration of an image forming apparatus 1 according to an exemplary embodiment of the invention.

The image forming apparatus 1 illustrated in FIG. 1 is a tandem color printer in which image forming units 10Y, 10M, 10C, and 10K for corresponding colors of yellow (Y), magenta (M), cyan (C), and black (K) are arranged side by side. The image forming apparatus 1 is capable of printing not only a single-color image but also a full-color image constituted by toner images of four colors. Toner cartridges 18Y, 18M, 18C, and 18K respectively contain toners of the colors of Y, M, C, and K.

Since the four image forming units 10Y, 10M, 10C, and 10K have almost the same configuration, the image forming unit 10Y corresponding to yellow (Y) is exemplarily described. The image forming unit 10Y includes a photoconductor drum 11Y, a charging device 12Y, an exposing device 13Y, a developing device 20Y, and a first transfer device 15Y. The image forming unit 10Y also includes a photoconductor cleaner 16Y that cleans the photoconductor drum 11Y. The photoconductor drum 11Y, the charging device 12Y, the exposing device 13Y, the developing device 20Y, and the first transfer device 15Y are supported by a housing F that supports the entirety of the image forming apparatus 1. The developing device 20Y is a developing device according to an exemplary embodiment of the invention, and the photoconductor drum 11Y is an exemplary latent image carrier in the invention.

The photoconductor drum 11Y is formed by disposing a photoconductor layer on a cylindrical base. The photoconductor drum 11Y rotates around a rotation axis O of the photoconductor drum 11Y in a direction of the arrow A while carrying an image on its surface. The charging device 12Y, the exposing device 13Y, the developing device 20Y, the first transfer device 15Y, and the photoconductor cleaner 16Y are arranged around the photoconductor drum 11Y in order in the direction of the arrow A.

The charging device 12Y is a device that charges the surface of the photoconductor drum 11Y. The charging device 12Y is a charging roller that contacts the surface of the photoconductor drum 11Y. A voltage that has the same polarity as a toner contained in the developing device 20Y is applied to the charging roller, and the charging roller charges the surface of the photoconductor drum 11Y by contacting it. The exposing device 13Y forms an electrostatic latent image by exposing the surface of the photoconductor drum 11Y to light. The exposing device 13Y emits a laser beam based on an image signal supplied from the outside of the image forming apparatus 1 and scans the surface of the photoconductor drum 11Y with the laser beam.

The developing device 20Y develops the surface of the photoconductor drum 11Y with a developer. A toner is supplied from the toner cartridge 18Y to the developing device 20Y. The developing device 20Y agitates a developer in which a magnetic carrier and a toner are mixed so that the toner and the magnetic carrier become charged, and develops the electrostatic latent image on the surface of the photoconductor drum 11Y with the charged toner.

The first transfer device 15Y is a roller that faces the photoconductor drum 11Y with the intermediate transfer belt 30 interposed therebetween. When a voltage is applied between the first transfer device 15Y and the photoconductor drum 11Y, the first transfer device 15Y transfers a toner image formed on the photoconductor drum 11Y to an intermediate transfer belt 30. The photoconductor cleaner 16Y cleans the surface of the photoconductor drum 11Y by removing remnants such as a toner remaining on the surface of the photoconductor drum 11Y after a transfer operation.

The image forming apparatus 1 also includes the intermediate transfer belt 30, a fixing device 60, a sheet transporting unit 80, and a controller 1A. The intermediate transfer belt 30 is an endless belt wrapped around belt supporting rollers 31 to 35. The intermediate transfer belt 30 rotates in a direction of the arrow B via the image forming units 10Y, 10M, 10C, and 10K and a second transfer device 50. Toner images of different colors are transferred from the image forming units 10Y, 10M, 10C, and 10K to the intermediate transfer belt 30. The intermediate transfer belt 30 moves while carrying the toner images of these colors.

The second transfer device 50 is a roller that rotates while nipping the intermediate transfer belt 30 and a sheet P between itself and a back-up roller 34, which is one of the belt supporting rollers 31 to 35. The second transfer device 50 includes an electrically conductive elastic layer on the surface. When a voltage that has a polarity opposite to that of a toner is applied to the second transfer device 50, the second transfer device 50 transfers the toner image formed on the intermediate transfer belt 30 to a sheet P.

The fixing device 60 is used to fix the toner image to the sheet P. The fixing device 60 includes a heating roller 61 and a compressing roller 62, and the heating roller 61 contains a heating device. The heating roller 61 and the compressing roller 62 cause a sheet P having a toner image formed thereon to pass therebetween while nipping the sheet P so that the toner image is fixed to the sheet P.

The sheet transporting unit 80 includes a pick-up roller 81 that picks up sheets P contained in the sheet container T, transporting rollers 82 that transport the sheets P, registration rollers 84 that transport the sheets P to the second transfer device 50, and ejecting rollers 86 that eject the sheets P to the outside. The sheet transporting unit 80 transports the sheets P along a sheet transport path R along which the sheets P pass the second transfer device 50 and the fixing device 60.

A fundamental operation of the image forming apparatus 1 illustrated in FIG. 1 will be described now. In the image forming unit 10Y corresponding to yellow, the photoconductor drum 11Y rotates in the direction of the arrow A and the surface of the photoconductor drum 11Y is charged by the charging device 12Y. The exposing device 13Y irradiates the surface of the photoconductor drum 11Y with exposure light based on an image signal corresponding to yellow among image signals supplied from the outside in order to form an electrostatic latent image on the surface of the photoconductor drum 11Y. The developing device 20Y receives a supply of a yellow toner from the toner cartridge 18Y and develops the electrostatic latent image formed on the photoconductor drum 11Y with the toner into a toner image. The photoconductor drum 11Y rotates while carrying the yellow toner image on its surface. The toner image formed on the surface of the photoconductor drum 11Y is transferred to the intermediate transfer belt 30 by the first transfer device 15Y. After the toner image is transferred, a toner remaining on the photoconductor drum 11Y is removed by the photoconductor cleaner 16Y.

The intermediate transfer belt 30 rotates in the direction of the arrow B. Like the image forming unit 10Y, the image forming units 10M, 10C, and 10K for colors other than yellow form toner images of the corresponding colors and transfer the toner images of the corresponding colors to the intermediate transfer belt 30 such that the toner images are superposed on the toner image having been transferred by the image forming unit 10Y.

The pick-up roller 81 picks up a sheet P from the sheet container T. The transporting rollers 82 and the registration rollers 84 transport the sheet P in the direction of the arrow C along the sheet transport path R toward the second transfer device 50. The registration rollers 84 feed the sheet P to the second transfer device 50 on the basis of the time when the toner images are transferred to the intermediate transfer belt 30. The second transfer device 50 produces an electric field between the intermediate transfer belt 30 and the sheet P to transfer the toner images formed on the intermediate transfer belt 30 to the sheet P. The sheet P to which the toner images have been transferred is transported to the fixing device 60, and the toner images are fixed to the sheet P by the fixing device 60. In this manner, an image is formed on the sheet P. The sheet P having the image formed thereon is ejected by the ejecting rollers 86 to the outside of the image forming apparatus 1.

Developing Device

Figure 2:
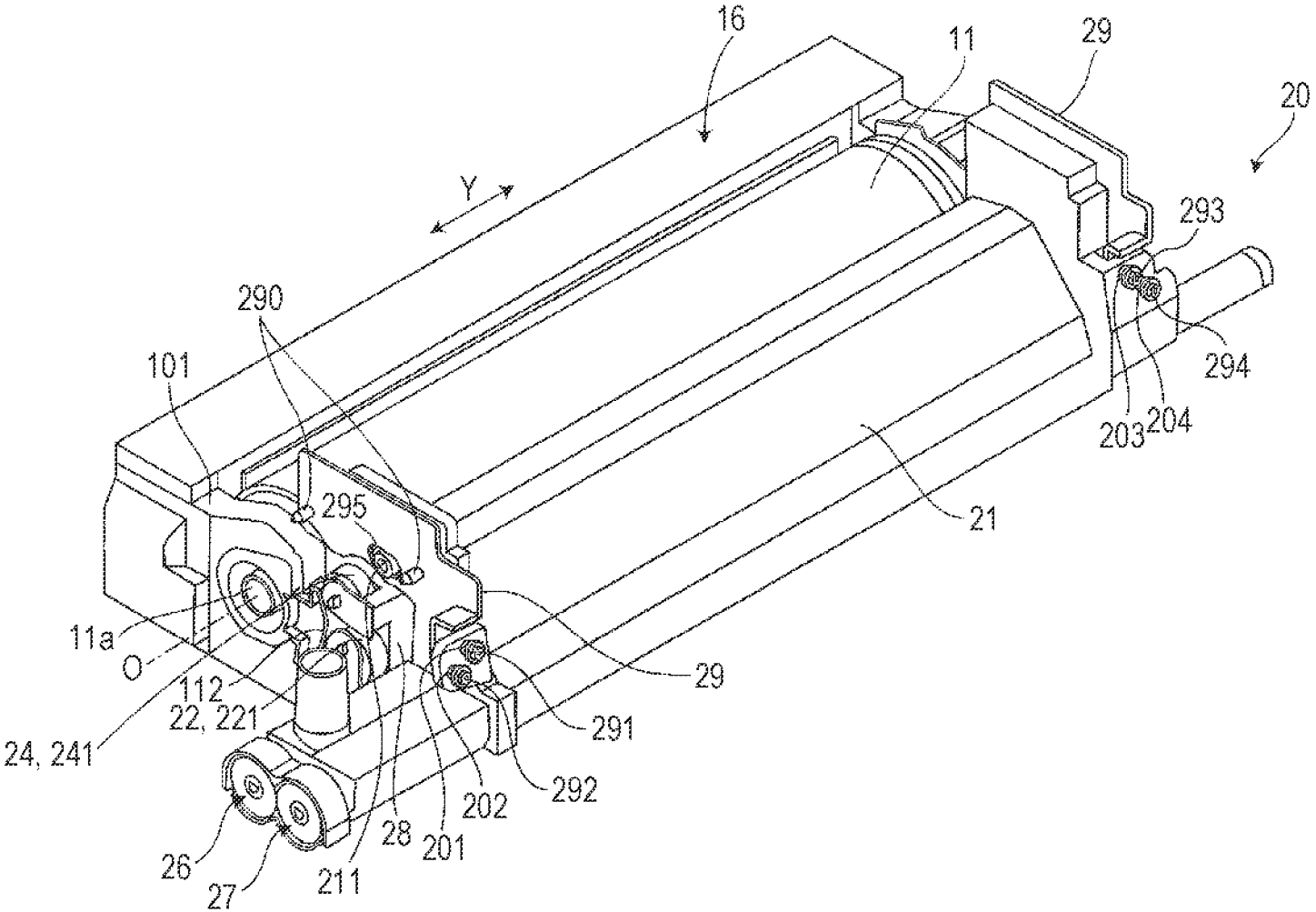
FIG. 2 is a perspective view of a developing device illustrated in FIG. 1.
Figure 3:
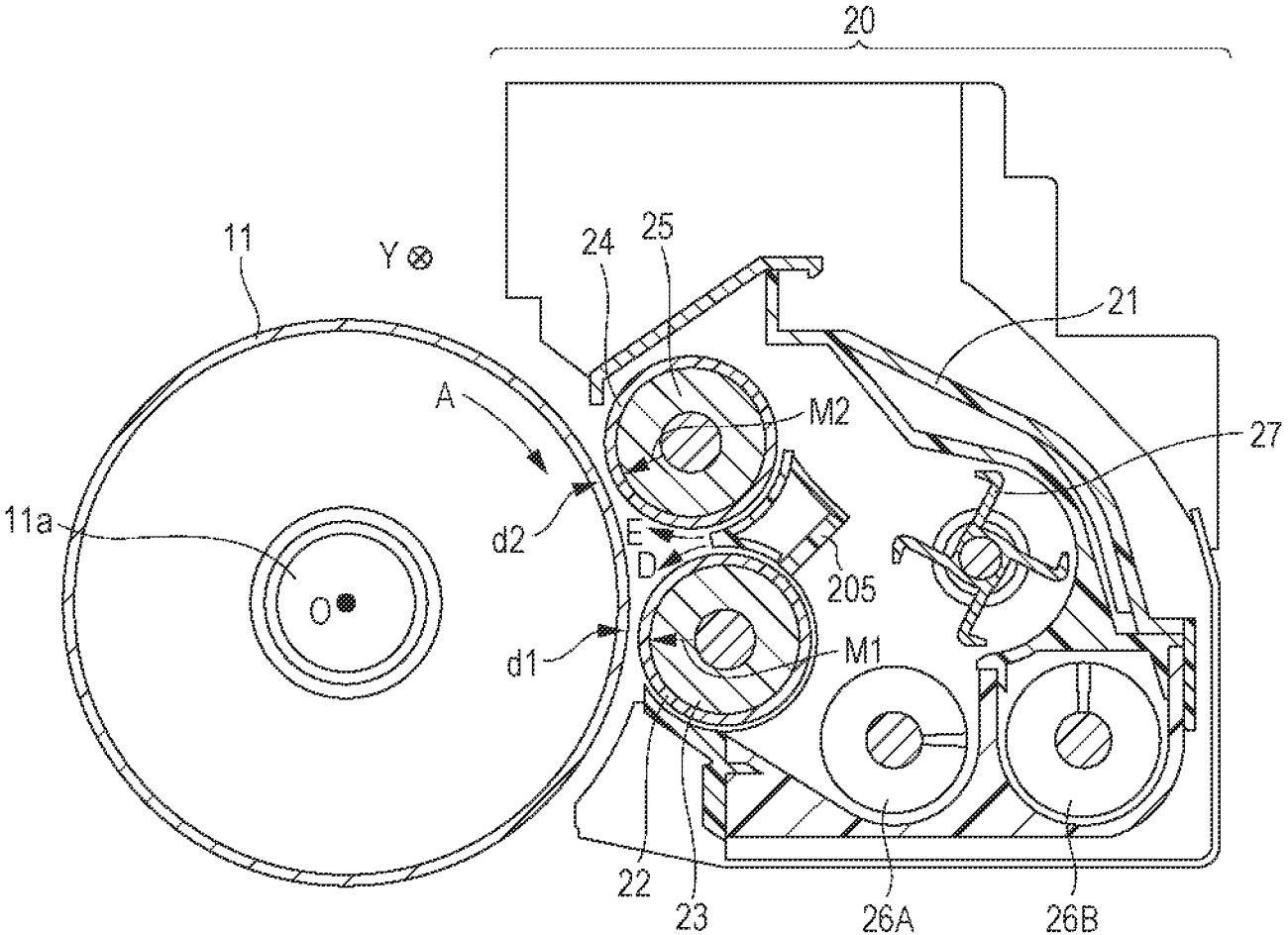
FIG. 3 is a cross-sectional view of the developing device illustrated in FIG. 2.

FIG. 2 is a perspective view of the developing device 20 illustrated in FIG. 1. Besides the developing device 20, FIG. 2 also illustrates a photoconductor drum 11 and a photoconductor cleaner 16. FIG. 3 is a cross-sectional view of the developing device 20 illustrated in FIG. 2. Besides the developing device 20, FIG. 3 also illustrates the photoconductor drum 11. Since the same configuration, illustrated in FIG. 2 and FIG. 3, is used for all the colors of Y, M, C, and K, developing devices, photoconductor drums, and photoconductor cleaners will be hereinafter denoted by simple reference numerals 20, 11, and 16, respectively.

The photoconductor drum 11, the photoconductor cleaner 16, and the developing device 20 are supported by a housing F (see FIG. 1) of the image forming apparatus 1. The photoconductor drum 11 is supported by the housing F (see FIG. 1) so as to be rotatable around an axis O of rotation. More specifically, shaft portions 11*a* of the photoconductor drum 11 are supported by drum supporters 101, which are secured to the housing F, via bearings 113 (see FIG. 4). Positioning members 112 are attached to the drum supporters 101.

The developing device 20 includes a container 21, a first development roller 22, a first magnet 23, a second development roller 24, a second magnet 25, a first agitating member 26A, a second agitating member 26B, a paddling member 27, a swinging member 28, and two supporting frames 29. The first development roller 22 is an exemplary first developer-transporting member in the invention and the second development roller 24 is an exemplary second developer-transporting member in the invention. The supporting frames 29 are exemplary supporters in the invention.

The supporting frames 29 are fixed to the housing F. Each supporting frame 29 includes securing projections 290 that protrude in the axial direction Y and that engage with the housing F (see FIG. 1).

The container 21 contains a developer and supports components of the developing device 20. Supporting projections 211 protrude at two end portions of the container 21 in the axial direction Y of the container. The supporting projections 211 are inserted in long holes 295 formed in the two supporting frames 29. FIG. 2 illustrates one of the paired supporting projections 211, which are formed on both sides in the axial direction Y. The developing device 20 also includes four urging members 201 to 204 that press the container 21 toward the photoconductor drum 11. The urging members 201 to 204 are interposed between the container 21 and corresponding adjustment screws 291 to 294 that are engaged with the corresponding supporting frames 29. A support structure of the supporting frames 29 and the container 21 will be described below.

The first development roller 22 and the second development roller 24 disposed in the container 21 are cylindrical components extending in the axial direction Y, and are disposed such that the circumferential surfaces of the development rollers 22 and 24 face the photoconductor drum 11. The first development roller 22 and the second development roller 24 are each disposed at a predetermined distance away from the photoconductor drum 11 so that a toner image of an appropriate density is obtainable.

The first development roller 22 is located downstream from the second development roller 24 in a direction of movement of the circumferential surface of the photoconductor drum 11, which rotates in the direction of the arrow A. The first magnet 23 is located inside the first development roller 22 and attracts the developer to the first development roller 22. The second magnet 25 is located inside the second development roller 24 and attracts the developer to the second development roller 24. The first development roller 22 and the second development roller 24 rotate to transport the developer from the container 21 to the surface of the photoconductor drum 11. In this exemplary embodiment, the first development roller 22 rotates in the direction of the arrow D, while the second development roller 24 rotates in the direction of the arrow E that is opposite to the direction in which the first development roller 22 rotates. In other words, the first development roller 22 and the second development roller 24 rotate such that opposing portions of their circumferential surfaces move in the same direction. A portion of the circumferential surface of the first development roller 22 that faces the photoconductor drum 11 in the first development region d1 moves in the same direction as the opposing portion of the circumferential surface of the photoconductor drum 11. A portion of the circumferential surface of the second development roller 24 that faces the photoconductor drum 11 in the second development region d2 moves in the opposite direction from the opposing portion of the circumferential surface of the photoconductor drum 11.

The first agitating member 26A and the second agitating member 26B agitate the developer contained in the container 21. The first agitating member 26A and the second agitating member 26B each have a structure in which a helical blade is helically formed on the rotation shaft that extends in the axial directions Y. The first agitating member 26A and the second agitating member 26B are arranged so as to be adjacent to each other, and the first agitating member 26A is located adjacent to the first development roller 22. The first agitating member 26A and the second agitating member 26B transport the developer in opposing axial directions Y by rotating. The developer is circulated in the container 21 while being agitated by the first agitating member 26A and the second agitating member 26B. The toner and the magnetic carrier in the developer become charged by being agitated.

The developer transported by the first agitating member 26A is attracted to the first development roller 22, supported on the first development roller 22, and moves in the direction of the arrow D of the first development roller 22. A plate-like thickness regulating member 205 is disposed at a portion over the circumferential surface of the first development roller 22 and between the first agitating member 26A and the second development roller 24. The thickness or the amount of the developer on the first development roller 22 to be transported is regulated by the thickness regulating member 205 and, thereafter, part of the developer is transferred to the second development roller 24. The part of the developer transferred to the second development roller 24 is transported by the second development roller 24 to the photoconductor drum 11 in the second development region d2. The developer remaining on the first development roller 22 is transported to the photoconductor drum 11 in the first development region d1.

The first magnet 23 has multiple magnetic poles that are arranged in the circumferential direction of the first development roller 22. Among the multiple magnetic poles, a development magnetic pole M1 illustrated in FIG. 3 is disposed at such an orientation with respect to the photoconductor drum 11 that an optimal developer brush for performing development is created in the first development region d1. A development magnetic pole M2 of the second magnet 25 is also disposed in such a direction with respect to the photoconductor drum 11 that an optimal developer brush for performing development is created in the second development region d2.

The photoconductor drum 11 comes into contact with the developer twice, i.e., in the second development region d2 and the first development region d1. When the toner in the developer adheres to the electrostatic latent image formed on the photoconductor drum 11, a toner image is formed. Part of the developer that remains after the rest of the developer has adhered to the photoconductor drum 11 in the first development region d1 is transported by the first development roller 22 back to the first agitating member 26A. Part of the developer that remains after the rest of the developer has adhered to the photoconductor drum 11 in the second development region d2 is transported by the second development roller 24 and recovered by the paddling member 27 back to the first agitating member 26A.

Support Structure of Supporting Frame and Container

Figure 4:
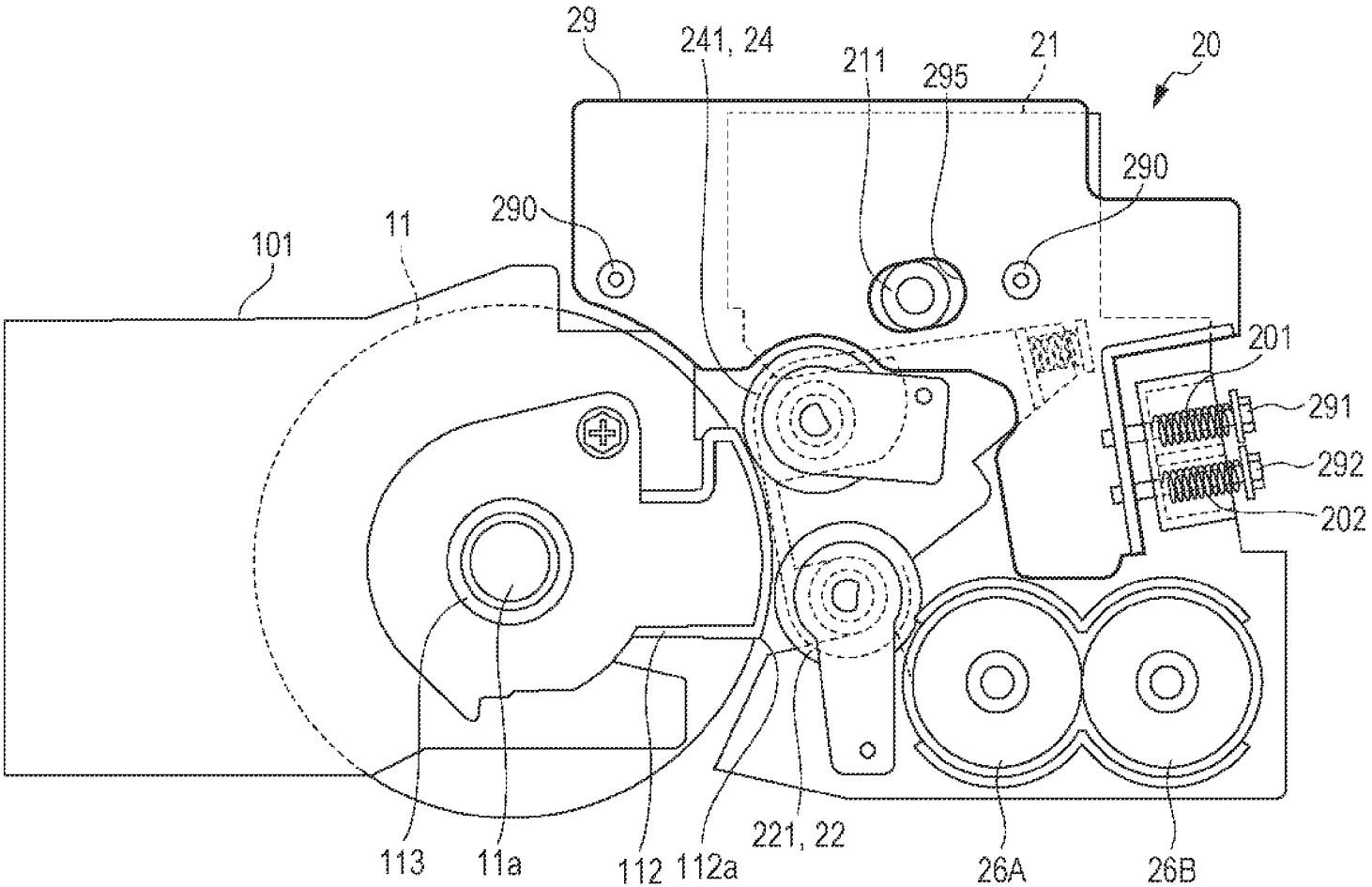
FIG. 4 is a schematic side view of the developing device illustrated in FIG. 2.

FIG. 4 is a schematic side view of the developing device illustrated in FIG. 2.

Referring also to FIG. 2 to FIG. 4, a support structure of the developing device 20 is described. The supporting frames 29 of the developing device 20 are secured to the housing F (see FIG. 1) of the image forming apparatus 1. The photoconductor drum 11 is also supported by the housing F (see FIG. 1) via bearings 113 and drum supporters 101.

The supporting projections 211 of the container 21 are inserted into long holes 295 formed in the supporting frames 29. The container 21 is suspended from the supporting frames 29 via the supporting projections 211. The long holes 295 of the supporting frames 29 longitudinally extend toward the photoconductor drum 11. Thus, the supporting projections 211 are movable toward the photoconductor drum 11. The container 21 supported by the supporting projections 211 is translationally movable toward the photoconductor drum 11 within a range in which the long holes 295 extend. In addition, the container 21 is supported so as to be capable of swinging, i.e., rotatable at an angle that is smaller than the angle of a full circle, around the supporting projections 211.

A pair of adjustment screws 291 and 292 engage with one of the supporting frames 29, and urging members 201 and 202 are interposed between the container 21 and the adjustment screws 291 and 292. The urging members 201 and 202 are compression springs and press the container 21 toward the photoconductor drum 11. FIG. 4 illustrates one of the two supporting frames 29 (see FIG. 2), but the other supporting frame 29 has the same configuration. Specifically, a pair of adjustment screws 293 and 294 (see FIG. 2) engage with the other supporting frame 29, and urging members 203 and 204, which are interposed between the container 21 and the adjustment screws 293 and 294, press the container 21 toward the photoconductor drum 11. Positioning of the container 21 is made when tracking rollers 221 of the first development roller 22 and tracking rollers 241 of the second development roller 24 are brought into contact with the positioning members 112. Here, as illustrated in FIG. 5A, the tracking rollers 221 of the first development roller 22 are mounted on shaft portions 22*a* of the first development roller 22 located on both end portions in the axial direction Y, and the tracking rollers 241 of the second development roller 24 are mounted on shaft portions 24*a* of the second development roller 24 located at two end portions in the axial direction Y. The tracking rollers 221 and 241 are rolling bearings that are similar to other bearings. The positioning members 112 each have a positioning surface 112*a* having a shape that follows the shape of the circumferential surface of the photoconductor drum 11. A predetermined gap between the photoconductor drum 11 and each of the first development roller 22 and the second development roller 24 is maintained by the four tracking rollers 221 and 241 coming into contact with the positioning surfaces 112*a* of the corresponding positioning members 112.

Figure 5B:
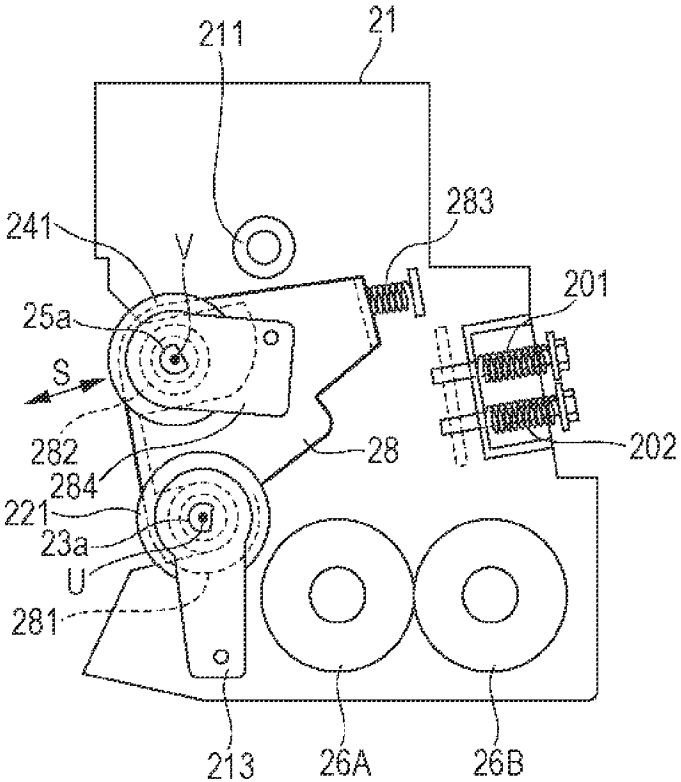
FIGS. 5A and 5B illustrate a supporting structure of development rollers in the developing device illustrated in FIG. 4, where
Figure 5A:
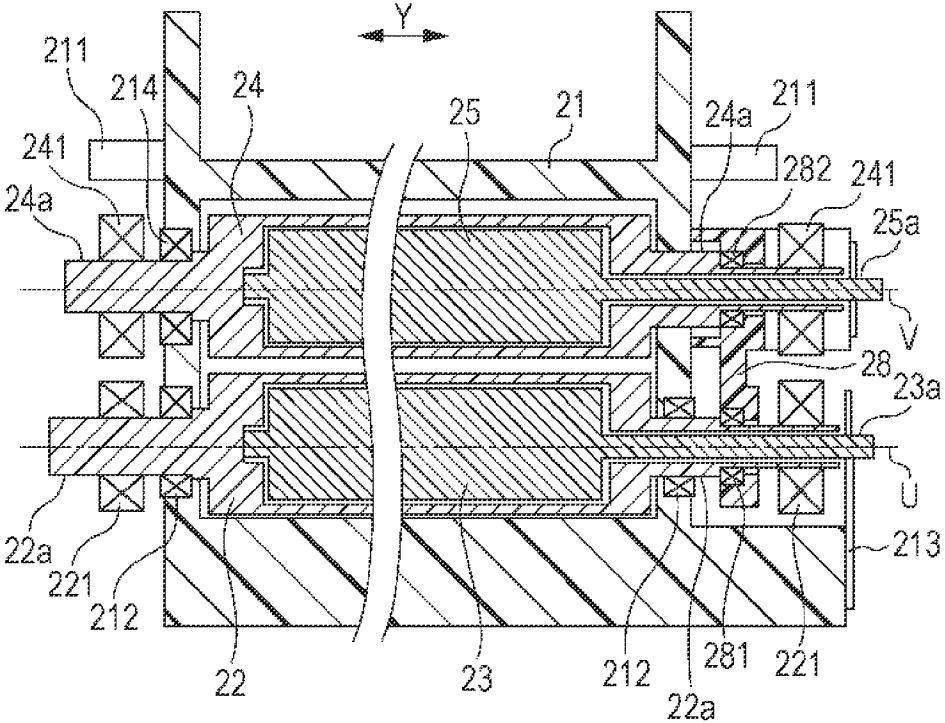

FIGS. 5A and 5B illustrate a support structure of development rollers 22 and 24 of the developing device 20 illustrated in FIG. 4. FIG. 5A is a cross-sectional view of the two development rollers 22 and 24. FIG. 5B is a schematic side view of the developing device 20. FIGS. 5A and 5B illustrate the state of the developing device 20 from which the supporting frames 29 are excluded.

The shaft portions 22*a* of the first development roller 22 located on both end portions in the axial direction Y are supported by the container 21 via bearings 212. The tracking rollers 221 are mounted on the shaft portions 22*a*. An end portion 23*a* of the first magnet 23 disposed inside the first development roller 22 penetrates through one of the shaft portions 22*a* of the first development roller 22 and protrudes from the shaft portion 22*a*. The protruding end portion 23*a* has a D-shaped cross section and is secured to a plate-like securing member 213 attached to the container 2. In other words, the position of the first magnet 23 is fixed by the container 21.

A swinging member 28 is mounted, via a bearing 212, on one of the shaft portions 22*a* of the first development roller 22 that is on the right side of the photoconductor drum 11, among the shaft portions 22*a* located on both end portions in the axial direction Y. The swinging member 28 is supported so as to be capable of swinging relative to the container 21 around the rotation axis U of the first development roller 22.

One shaft portion 24*a* located on the right side among the shaft portions 24*a* located on both end portions of the second development roller 24 in the axial direction Y is rotatably supported by the swinging member 28 via a bearing 282, and the other shaft portion 24*a* (located on the left side) is supported by the container 21 via a bearing 214, as in the case of the first development roller 22. The end portion (or the shaft portion 24*a*) of the second development roller 24 that is supported by the swinging member 28 is capable of swinging around the rotation axis U of the first development roller 22 toward or away from the photoconductor drum 11 in the direction of the arrow S illustrated in FIG. 5B. A shaft compressing member 283, which presses the swinging member 28 toward the photoconductor drum 11, is interposed between the swinging member 28 and the container 21. The shaft compressing member 283 is a compression spring, and presses the end portion (or the shaft portion 24*a*) of the second development roller 24, supported by the swinging member 28, toward the photoconductor drum 11. The tracking rollers 241 are mounted on the shaft portions 24*a* located on both end portions of the second development roller 24 in the axial direction Y. An end portion 25*a* of the second magnet 25, disposed inside the second development roller 24, in the axial direction Y protrudes from one of the cylindrical shaft portions 24*a* of the second development roller 24. The protruding end portion 25*a* has a D-shaped cross section as in the case of the first magnet 23 and is secured to a plate-like securing member 284 that is attached to the swinging member 28. In other words, the position of the second magnet 25 is fixed by the swinging member 28.

As described above, the container 21 of the developing device 20 attached to the housing F of the image forming apparatus 1 is pressed by the urging members 201 to 204 toward the photoconductor drum 11 (see FIG. 4). Specifically, the four tracking rollers 221 and 241 of the first and second development rollers 22 and 24 are brought into contact with the positioning members 112 (see FIG. 4).

Here, individual products including the housing F, the photoconductor drum 11, and the developing device 20 of the image forming apparatus 1 each bear dimensional tolerances, and there are also tolerances relating to positions at and orientations in which the photoconductor drum 11 and the developing device 20 are installed. In the case, for example, where both end portions of the first and second development rollers 22 and 24, that is, four end portions are directly supported by the container via bearings, if there is a slight orientational deviation due to the dimensional or positional tolerances, one of the four tracking rollers 221 and 241 may become separated from the corresponding positioning member 112 while the remaining three tracking rollers 221 and 241 are in contact with the corresponding positioning members 112.

In the developing device 20 according to the exemplary embodiment, on the other hand, the shaft portion 24*a* located on one end portion in the axial direction Y, among the shaft portions 24*a* of the second development roller 24, is supported by the swinging member 28 via the bearing 282, and thus moves toward or away from the photoconductor drum 11 in the direction of the arrow S. For this reason, all the four tracking rollers 221 and 241 come into contact with the corresponding positioning members 112. Consequently, a gap between a circumferential surface of the photoconductor drum 11 and each of the first and second development rollers 22 and 24 is prevented from becoming uneven throughout its full length in the axial direction Y.

If, for example, the second magnet 25 is secured to the container 21 instead of the swinging member 28, the orientation of the development magnetic pole M2 (see FIG. 3) with respect to the photoconductor drum 11 changes as the shaft portion 24*a* of the second development roller 24 supported by the swinging member 28 moves in the direction of the arrow S. In this case, the orientation of the development magnetic pole M2 varies depending on dimensional or positional tolerances of the apparatus and consequently the state of a developer brush created in the second development region d2 varies.

On the other hand, the second magnet 25 according to the exemplary embodiment is secured to the swinging member 28. Thus, when the second development roller 24 changes its position in accordance with a swing of the swinging member 28, the second magnet 25 secured to the swinging member 28 changes its position together with the second development roller 24 while maintaining its orientation with respect to the circumferential surface of the photoconductor drum 11. Consequently, when the second development roller 24 moves in the direction of the arrow S, the orientation of the development magnetic pole M2 with respect to the photoconductor drum 11 deviates less than in the case where the second magnet 25 is secured to the container 21.

Positions of Urging Members

Next, the positional relationship between the photoconductor drum 11 and each of the urging members 201 to 204 of the developing device 20 will be described.

Figure 6:
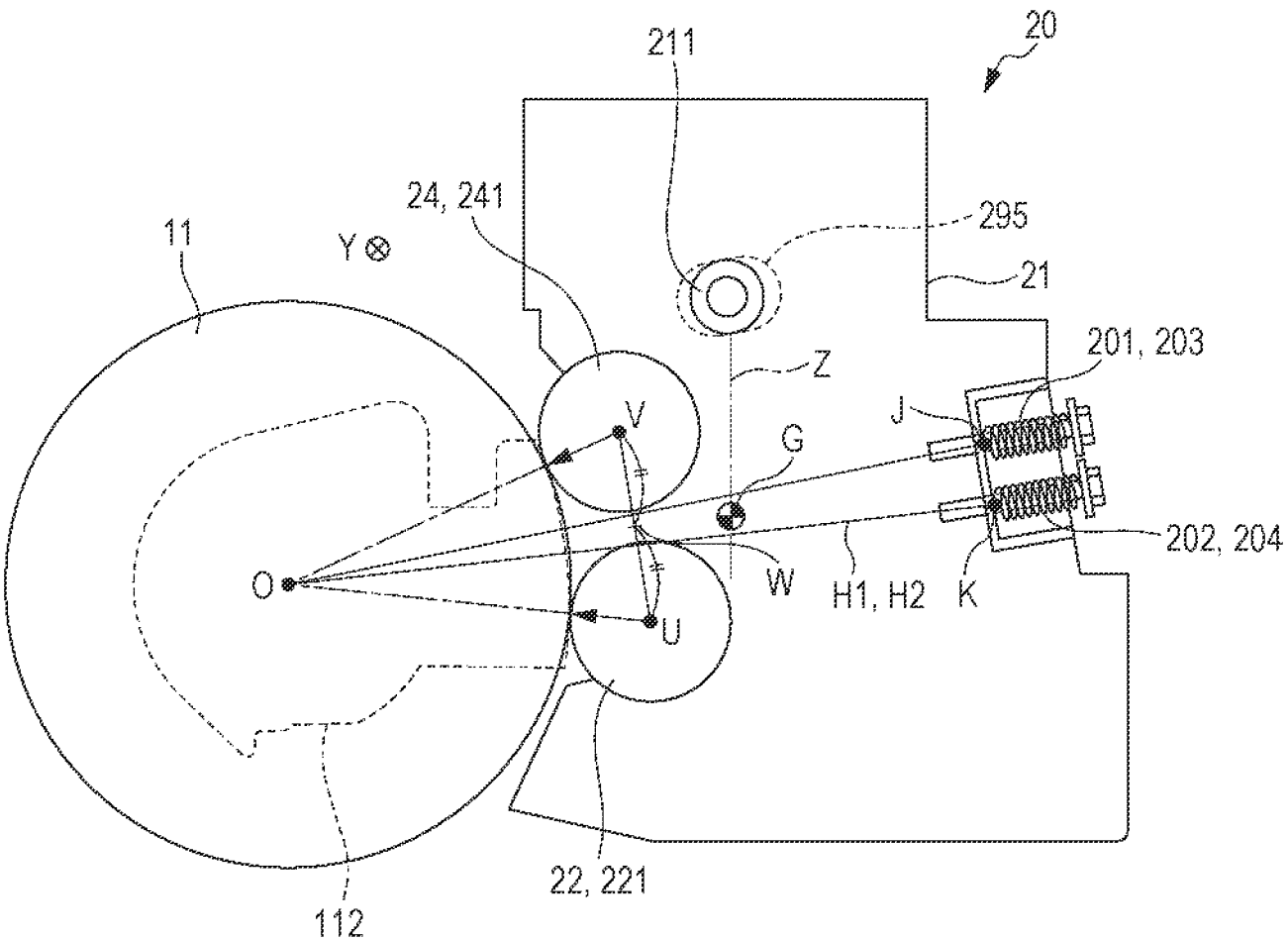
FIG. 6 illustrates the positional relationship between urging members of the developing device illustrated in FIG. 2 to FIG. 5B and a photoconductor drum.

FIG. 6 illustrates the positional relationship between the photoconductor drum 11 and each of the urging members 201 to 204 of the developing device 20 illustrated in FIG. 2 to FIG. 5B.

FIG. 6 illustrates points of application J and K at which the pair of the urging members 201 and 202 act on the container 21 of the developing device 20, the rotation axis O of the photoconductor drum 11, a rotation axis U of the first development roller 22, a rotation axis V of the second development roller 24, and the center of gravity G of the developing device 20. The points J and K, the axes O, U, and V, and the center of gravity G are projections that are projected in the axial direction Y. Specifically, the center of gravity G of the developing device 20 is the center of gravity G of part of the developing device 20 excluding the supporting frame 29 (see FIG. 4) in a state where the container 21 contains an amount of a developer that is typically required for image formation.

The pair of urging members 201 and 202, or more specifically, the points of application J and K of the urging members 201 and 202 serve as vertexes of a first triangle H1 together with the rotation axis O of the photoconductor drum 11, when projected in the axial direction Y as illustrated in FIG. 6. The first triangle H1 is formed around the center of gravity G of the developing device 20. In other words, when projected in the axial direction Y as illustrated in FIG. 6, the points of application J and K of the urging members 201 and 202 are positioned so as to serve as two vertexes of the first triangle H1 that surrounds the center of gravity G of the developing device 20 while the rotation axis O of the photoconductor drum 11 serves as the remaining vertex of the first triangle H1. Another pair of the urging members 203 and 204, or more specifically, the points of application J and K of the urging members 203 and 204 are positioned so as to serve as vertexes of a second triangle H2 while the rotation axis O of the photoconductor drum 11 serves as the remaining vertex of the second triangle H2. In the exemplary embodiment, the first triangle H1 and the second triangle H2 coincide with each other.

The center of gravity G of the developing device 20 is positioned on a vertical plane Z that passes through a pair of supporting projections 211 located on both end portions of the container 21 in the axial direction Y.

A middle point W of a line segment connecting the rotation axis U of the first development roller 22 and the rotation axis V of the second development roller 24 is positioned so as to be surrounded by the first triangle H1 and the second triangle H2. The second development roller 24 according to the exemplary embodiment is supported by the swinging member 28 (see FIGS. 5A and 5B) and moves in the direction of the arrow S illustrated in FIG. 5B for adjustment. Even when the second development roller 24 moves for adjustment within a certain range, the middle point W remains surrounded by the first triangle H1 and the second triangle H2.

In the developing device 20 according to the exemplary embodiment, a pair of urging members 201 and 202 are disposed at one end portion of the container 21 in the axial direction Y and another pair of urging members 203 and 204 are disposed at another end portion of the container 21 in the axial direction Y.

If, for example, one urging member is disposed at each end portion in the axial direction Y, when the direction of a force produced by the urging member at the corresponding end portion deviates from the rotation axis O of the photoconductor drum 11, a moment that rotates the container 21 around the center of gravity G is produced. Unlike in the above case, a moment that rotates the container 21 is less likely to be produced in the developing device 20 according to the exemplary embodiment. In the developing device 20 according to the exemplary embodiment, when the image forming apparatus is projected in the axial direction Y, the center of gravity G is positioned in the first triangle H1, in which the rotation axis O of the photoconductor drum 11 and the pair of urging members 201 and 202 serve as vertexes, and in the second triangle H2, in which the rotation axis O of the photoconductor drum 11 and the other pair of urging members 203 and 204 serve as vertexes. For this reason, a moment that rotates the container 21 and that is attributable to a force with which the urging members 201 to 204 press the container 21 is less likely to be produced than in the case, for example, where the center of gravity G is not positioned in the first triangle H1 or the second triangle H2.

In the developing device 20 according to the exemplary embodiment, the middle point W of a line segment connecting the rotation axis U of the first development roller 22 and the rotation axis V of the second development roller 24 is positioned so as to be surrounded by the first triangle H1 and the second triangle H2. Thus, a pressing force is more likely to be more evenly applied from the urging members 201 and 202 to the first and second development rollers 22 and 24 than in the case, for example, where the middle point W is not surrounded by the first triangle H1 and the second triangle H2. Consequently, a force with which the first and second development rollers 22 and 24 press the photoconductor drum 11, or more specifically, a force with which the tracking rollers 221 and 241 of the first and second development rollers 22 and 24 come into contact with the corresponding positioning members 112 of the photoconductor drum 11 is more likely to be applied more evenly.

If, for example, the center of gravity G is not on the vertical plane Z, a moment due to the weight of the developing device 20 acts on the developing device 20 that is suspended via the supporting projections 211, in addition to the pressing force of the urging members 203 and 204. In this case, a force unevenly acts on the first and second development rollers 22 and 24. In the developing device 20 according to the exemplary embodiment, on the other hand, the center of gravity G of the developing device 20 is positioned on the vertical plane Z that passes through the supporting projections 211. Thus, the moment due to the weight of the developing device 20 is less likely to be produced than in the case, for example, where the center of gravity G is not positioned on the vertical plane Z. Consequently, a force is more likely to be more evenly applied to the first and second development rollers 22 and 24.

In the exemplary embodiment, the case where the tracking rollers 221 and 241 come into contact with the positioning members 112 is illustrated. However, the tracking rollers 221 and 241 may directly come into contact with the circumferential surface of the photoconductor drum 11.

In the exemplary embodiment, the first triangle H1, which is formed by the pair of urging members 201 and 202 and the rotation axis O of the photoconductor drum 11, and the second triangle H2, which is formed by another pair of the urging members 203 and 204 located on another end portion and the rotation axis O of the photoconductor drum 11, coincide with each other when the urging members 201 to 204 and the axis O are projected in the axial direction Y. However, the present invention is not limited to this, and the first triangle H1 and the second triangle H2 may differ from each other.

In the exemplary embodiment, the second development roller 24 located upstream from the first development roller 22 in the direction of rotation of the circumferential surface of the photoconductor drum 11 is exemplarily illustrated as a second developer-transporting member. However, the present invention is not limited to this, and the second developer-transporting member may be disposed downstream from the first developer-transporting member. Alternatively, the first and second developer-transporting members may rotate in directions that are opposite to the directions of rotation of the first and second development rollers 22 and 24 described in the exemplary embodiment.

In the above-described exemplary embodiment, a configuration in which a charging roller and a laser exposing device are included is illustrated as an exemplary image forming apparatus in the invention. The image forming apparatus in the invention, however, is not limited thereto, and may include, for example, a corona discharge device such as a corotron or scorotron instead of the charging roller or may include an array of multiple light emitting diodes instead of the laser exposing device. Alternatively, the image forming unit in the invention may be, for example, one that directly applies a voltage corresponding to an image to an image carrier by using an electrode array.

In the above-described exemplary embodiment, a tandem color printer is illustrated as an exemplary image forming apparatus. The image forming apparatus in the invention, however, is not limited thereto, and may be, for example, a single-color printer that does not include an intermediate transfer belt.

In the above-described exemplary embodiment, a printer is illustrated as an exemplary image forming apparatus. The image forming apparatus in the invention, however, is not limited to a printer, and may be, for example, a copying machine or a fax machine.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a housing;

a latent image carrier that is rotatably supported by the housing, the latent image carrier being cylindrical, the latent image carrier having a surface on which an electrostatic latent image is formed and developed;

a developing device that develops the electrostatic latent image formed on the latent image carrier; and a supporter that is secured to the housing, the supporter supporting a container of the developing device such that the container is movable toward or away from the latent image carrier, wherein the developing device includes the container that contains a developer, a first developer-transporting member and a second developer-transporting member each having a rotation axis that is substantially parallel with a rotation axis of the latent image carrier, the first and second developer-transporting members each being disposed such that a circumferential surface thereof faces the latent image carrier, the first and second developer-transporting members each transporting the developer to a position at which the developer faces the latent image carrier by rotating in a circumferential direction of the circumferential surface while carrying the developer on the circumferential surface, and the first and second developer-transporting members being positioned so as to be adjacent to each other, a first magnet and a second magnet disposed inside the first and second developer-transporting members, respectively, the first and second magnets attracting the developer to the circumferential surfaces of the first and second developer-transporting members, respectively, and a pair of first urging members pressing the container toward the latent image carrier while being interposed between the supporter and the container at a first end portion in a direction of the rotation axes of the first and second developer-transporting members, and wherein when the image forming apparatus is projected in the direction of the rotation axis of the latent image carrier, the center of gravity of the developing device is positioned so as to be surrounded by a triangle in which the rotation axis of the latent image carrier, a portion of the container at which one of the first urging members presses, and a portion of the container at which the other first urging member presses serve as vertexes of the triangle.

2. The image forming apparatus according to claim 1, wherein the developing device includes a pair of second urging members pressing the container toward the latent image carrier while being interposed between the supporter and the container at a second end portion in the direction of the rotation axes of the first and second developer-transporting members, and wherein when the first and second developer-transporting members are projected in the direction of the rotation axis of the latent image carrier, the first and second developer-transporting members are positioned such that a middle point of a line segment connecting the rotation axis of the first developer-transporting member and the rotation axis of the second developer-transporting member is surrounded by the triangle.

3. The image forming apparatus according to claim 2, wherein the container includes a pair of supporting projections, which protrude in the direction of the rotation axes of the first and second developer-transporting members, at the first and second end portions in the direction of the rotation axes, the supporting projections allowing the container to be supported by the supporter such that the container is suspended from the supporter, and wherein the center of gravity is on a vertical plane that passes through the pair of supporting projections.

4. The image forming apparatus according to claim 3, wherein the first developer-transporting member is rotatably supported by the container, wherein the first magnet is secured to the container, wherein the developing device further includes a swinging member that is supported so as to be capable of swinging relative to the container around the rotation axis of the first developer-transporting member, wherein at least one end portion of the second developer-transporting member is rotatably supported by the swinging member, and wherein the second magnet is secured to the swinging member.

5. The image forming apparatus according to claim 2, wherein the first developer-transporting member is rotatably supported by the container, wherein the first magnet is secured to the container, wherein the developing device further includes a swinging member that is supported by the container so as to be capable of swinging relative to the container around the rotation axis of the first developer-transporting member, wherein at least one end portion of the second developer-transporting member is rotatably supported by the swinging member, and wherein the second magnet is secured to the swinging member.

6. The image forming apparatus according to claim 1, wherein the container includes a pair of supporting projections, which protrude in the direction of the rotation axes of the first and second developer-transporting members, at the first and second end portions in the direction of the rotation axes, the supporting projections allowing the container to be supported by the supporter such that the container is suspended from the supporter, and wherein the center of gravity is on a vertical plane that passes through the pair of supporting projections.

7. The image forming apparatus according to claim 6, wherein the first developer-transporting member is rotatably supported by the container, wherein the first magnet is secured to the container, wherein the developing device further includes a swinging member that is supported so as to be capable of swinging relative to the container around the rotation axis of the first developer-transporting member, wherein at least one end portion of the second developer-transporting member is rotatably supported by the swinging member, and wherein the second magnet is secured to the swinging member.

8. The image forming apparatus according to claim 1, wherein the first developer-transporting member is rotatably supported by the container, wherein the first magnet is secured to the container, wherein the developing device further includes a swinging member that is supported by the container so as to be capable of swinging relative to the container around the rotation axis of the first developer-transporting member, wherein at least one end portion of the second developer-transporting member is rotatably supported by the swinging member, and wherein the second magnet is secured to the swinging member.

* * * * *